United States Patent [19]

Wiley

[11] 4,353,544

[45] Oct. 12, 1982

[54] POLE SUPPORTED BICYCLE-TYPE EXERCISER

[76] Inventor: W. Don Wiley, P.O. Box 66, Foster, Okla. 73039

[21] Appl. No.: 206,585

[22] Filed: Nov. 13, 1980

[51] Int. Cl.[3] ..... A63B 23/04

[52] U.S. Cl. ..... 272/73; 187/11

[58] Field of Search ..... 272/73, 70.3, 120, 121, 272/125, 126, 134; 187/11, 20, 23, 26, 27, 1 R, 68, 69, 70, 67

[56] References Cited

U.S. PATENT DOCUMENTS

| | | | |
|---|---|---|---|
| 109,232 | 11/1870 | McKenzie | 187/11 |
| 555,456 | 2/1896 | Littleworth | 187/67 |
| 583,562 | 6/1897 | Woodard | 187/11 |
| 583,920 | 6/1897 | Montgomery | 272/73 |
| 1,110,499 | 9/1914 | Laborda | 187/1 R |
| 1,110,566 | 9/1914 | Laborda | 187/1 R |
| 2,562,634 | 7/1951 | Nelson | 187/11 |
| 3,126,071 | 3/1964 | Basset | 272/73 X |

FOREIGN PATENT DOCUMENTS

| | | | |
|---|---|---|---|
| 342351 | 7/1904 | France | 272/73 |
| 208406 | 10/1923 | United Kingdom | 272/73 |

*Primary Examiner*—Richard C. Pinkham
*Assistant Examiner*—Arnold W. Kramer
*Attorney, Agent, or Firm*—Robert K. Rhea

[57] ABSTRACT

A seat equipped frame, vertically slidably supported on an upright pole having handle bars at its upper end, is provided with pedals and a crank angularly rotating a reel about a horizontal axis for winding an elongated flexible member thereon, secured at one end to an intermediate portion of the pole, for lifting the frame and an occupant in response to angular rotation of the reel in one direction. Downward movement of the frame, from its lifted position, is retarded by air trapped below a piston, moved upwardly with the frame, in a tube to form a brake.

2 Claims, 3 Drawing Figures

POLE SUPPORTED BICYCLE-TYPE EXERCISER

BACKGROUND OF THE INVENTION

1. Field of the Invention

The present invention relates to stationary bicycle-type exerciser machines and more particularly to a single pole supported exerciser.

2. Description of the Prior Art

Most stationary bicycle-type exerciser machines presently in use comprise a stationary seat equipped bicycle-like frame or a portion thereof journalling one or two wheels and having a pedal-sprocket and chain drive for the wheel. The exerciser is usually equipped with a brake for retarding rotation of the wheel in accordance with a desired resistance to the pedals for exercising the leg muscles of the user.

The most pertinent prior patent is believed U.S. Pat. No. 3,126,071 which discloses a frame, including a seat and a pair of pedals slidably mounted on a pole. The pole is provided with a rack. Frame mounted pawls, actuated by a pitman operated by the pedal crank in an eccentric fashion, pivots a lever about a pin to alternately engage the pawls with the rack teeth to raise the frame and user relative to the pole when the control is in an "up" position in an action similar to the action of an automotive bumper jack. Conversely, when the control is in the "down" position, continued pedal movement operating the pitman, progressively lowers the frame and the user.

This invention is distinctive over this patent by providing a pole having bicycle-like handles at its upper end and a frame vertically slidable on the pole. A reel, journalled by the depending end portion of the frame, is manually rotated by a crank and foot pedals for winding a flexible member secured at one end to the reel and secured at its other end to the pole for winding the flexible member on the reel and lifting the frame and user. Brake means retards downward movement of the frame after being lifted.

SUMMARY OF THE INVENTON

A pole is vertically mounted on a base. An elongated vertically disposed open frame surrounds the pole in vertically spaced positions. Friction reducing rollers, journalled by the frame ends, bear against diametrically opposite sides of the pole to prevent a binding action of the frame on the pole as the frame is moved vertically relative to the pole. The depending end portion of the frame journals a reel about the horizontal axis of a bicycle-like crank equipped with pedals. An elongated flexible member, secured at one end to the reel and secured at its other end to the pole adjacent the upper limit of the frame, is wound on the reel by the user operating the pedals and angularly rotating the reel which lifts the frame and user relative to the pole. An air pump-type brake member retards downward movement of the frame from a raised position and comprises a tube parallel with the pole and substantially coextensive with the frame, including a coaxial rod connected at one end with the upper limit of the frame and provided with a cup-like plunger at its depending end which compresses air within the tube which is gradually released through a tube orifice as the frame moves downwardly.

The principal object is to provide a stationary bicycle-type exerciser in which the user must exert pressure on bicycle-like pedals proportional to his weight in order to lift himself and a frame relative to a vertical support pole.

DESCRIPTION OF THE PREFERRED EMBODIMENT

Figure 3:
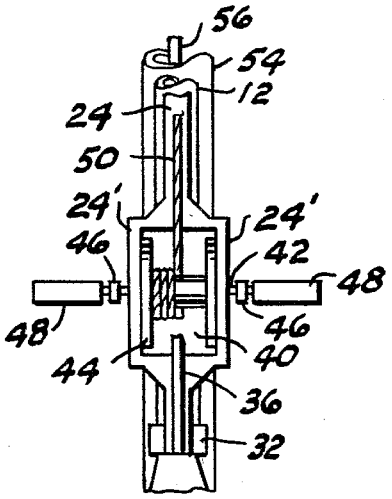

Like characters of reference designate like parts in those figures of the drawings in which they occur.

In the drawings

The device 10 comprises an upright tubular pole 12 centrally mounted on a base 14 and a frame means 16 vertically movable relative to the pole. An upper pole extension rod 18, having laterally spaced handles 20, at its upper end, is telescopically received by the upper end portion of the pole 12 and held in a vertically adjusted position by a set screw 22. The frame 16 includes a vertical standard 24 having a generally horizontally disposed strap-like top member 26 secured to its upper end which supports a seat 28 laterally of the pole with its other end portion slidably surrounding an intermediate portion of the pole.

A first friction reducing roller 30 is horizontally journalled by the frame top member 26 on that side of the pole oposite the seat. The depending end portion of the standard 24 is connected with one end portion of a frame strap-like bottom member 32, similarly slidably surrounding an intermediate portion of the pole 12, and horizontally journalling a second friction reducing roller 34 bearing against the pole 12 on the opposite side of the pole with respect to the first roller 30. The purpose of the rollers 30 and 34 are to prevent a binding action of the frame top and bottom members 26 and 32 on the pole 12 as the frame is moved vertically relative to the pole, as presently explained.

Figure 2:
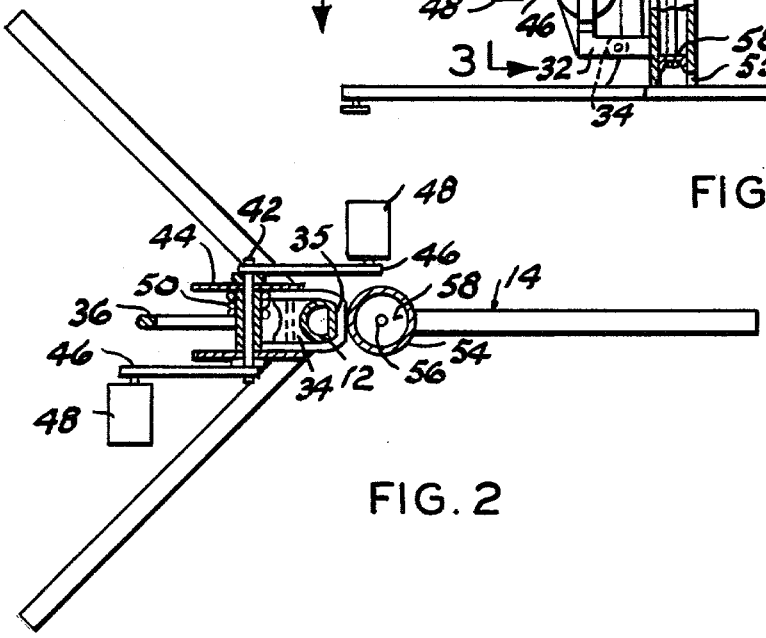
FIG. 2 is a horizontal sectional view, to a larger scale, partially in elevation, taken substantially along the line 2—2 of FIG. 1; and, FIG. 3 is a fragmentary elevational view looking in the direction of the arrows 3—3 of FIG. 1.

As shown by FIG. 2, the depending end portion of the pole wall is flattened, as at 35, on that side of the pole opposite the frame from the frame top member 26 to the depending end of the pole for the purpose of preventing angular rotation of the frame relative to the vertical axis of the pole. The frame bottom member 32 cooperatively contacts the pole flat surface 35.

An angularly disposed seat brace 36 extends between the frame top and bottom members 26 and 32 to brace the seat. Crank and reel means 38 is connected with the depending end portion of the frame standard 24 for raising and lowering the frame relative to the pole.

At its lower end portion, the standard 24 is vertically divided (FIG. 3) and spread apart to form a box-like opening 40 defined by opposing side members 24', which horizontally journal the axle 42 of a reel 44. The reel axle 42 projects beyond the respective standard side members 24' and the projections are connected with crank and pedal arms 46 extending in opposing directions and each having a bicycle-like foot pedal 48 secured to its other end for the purposes of angularly rotating the reel 44 about its axis by the user operating the foot pedals when seated on the seat 28. An elongated flexible member 50 is secured at one end to the reel axle 42 and is secured at its other end to the pole 12 adjacent the depending limit of the frame top member 26.

Brake means 52 retards downward movement of the frame relative to the pole and comprises an elongated upwardly open tube 54 substantially coextensive with the frame. The tube 54 is provided with an orifice 55 at its depending end. A piston rod 56 is coaxially disposed within the tube 54 and is connected at its upper end with the frame top member 26 and secured at its depending end with a piston 58 coaxially slidable in the tube 54. The piston 58 is preferably an air pump-type cup which permits air to enter the tube 54 below the piston as the rod 56 is moved upwardly, as presently explained.

Operation

Figure 1:
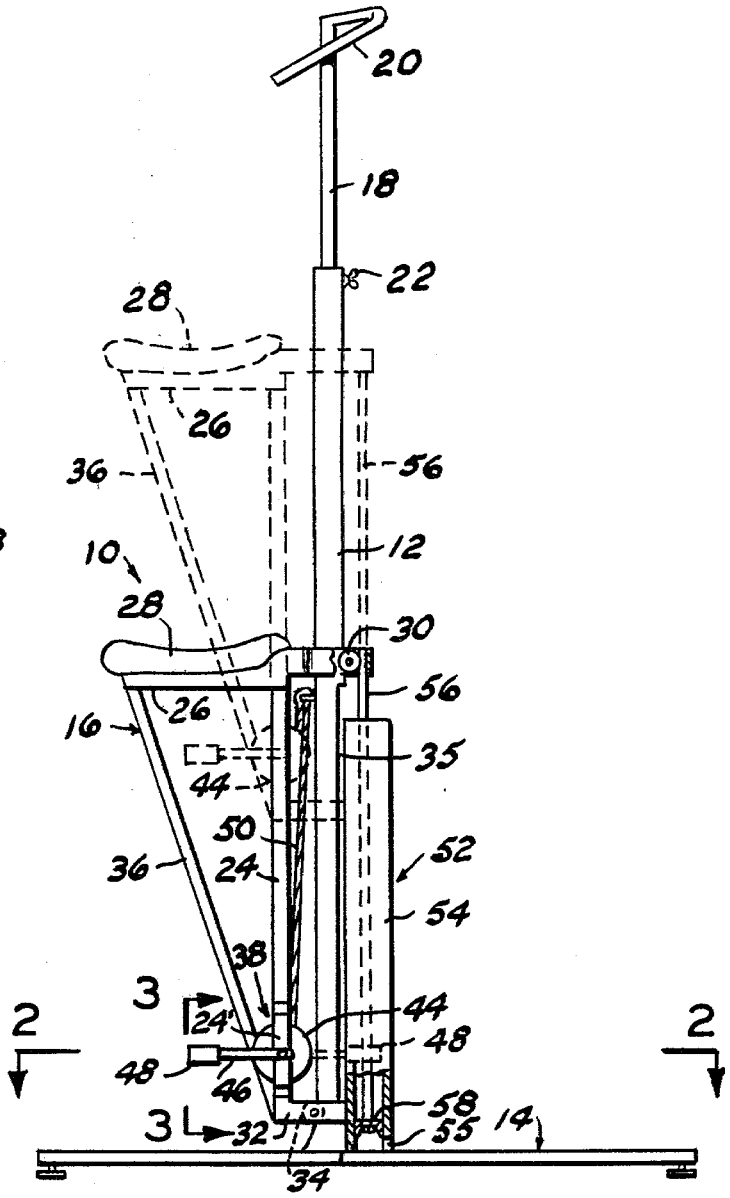
FIG. 1 is a side elevational view, partially in section, of the device.

With the frame 16 disposed in its solid line position of FIG. 1, the operator seats himself on the seat 28, grasps the handles 20, places his feet on the pedals 48 and by foot and leg operation of the pedals 48 angularly rotates the reel 44 to wind the flexible member 50 thereon which elevates the frame and the operator relative to the pole 12 until the frame reaches its upper dotted line position of FIG. 1. The operator may partially lift himself by the handle bars 20 thus reducing the effort required of his feet and leg muscles and simultaneously exercising his arm muscles. During this action, the piston rod 56 is moved vertically with the frame and traps air in the tube 54 below the piston 58. Downward movement of the frame and the user is then accomplished by slowly rotating the pedals in an opposite direction. Downward movement of the frame and the user is retarded by air trapped in the tube 54 below the piston 58 which is gradually released by the tube orifice 55 in a braking action.

Obviously the invention is susceptible to changes or alterations without defeating its practicability. Therefore, I do not wish to be confined to the preferred embodiment shown in the drawings and described herein.

I claim:

1. A leg and arm muscle exerciser, comprising:

an upright pole having handle bars at its upper end;

frame means mounted on said pole for vertical sliding movement relative to said pole, said frame means including an upright frame having top and bottom members respectively surrounding an intermediate portion of said pole, and, first and second rollers respectively journaled by said frame top and bottom members on diametrically opposite sides of said pole;

a seat mounted on said frame means;

a reel having an axle projecting laterally of opposing sides of and journaled by said frame for angular rotation about a horizontal axis;

an elongated flexible member secured at one end to said reel and secured at its other end to an intermediate portion of said pole spaced above said reel;

foot pedal means secured to said reel for angularly rotating said reel in a winding up and paying out action of said flexible member on said reel, said foot pedal means including a crank arm secured at one end portion to each end of said reel axle forming a cooperating pair of crank arms projecting in opposing directions, and, a foot pedal secured to the other end portion of each said crank arm; and, brake means for retarding downward movement of said frame means relative to said pole, said brake means comprising, an elongated upwardly open brake tube having an orifice in its depending end portion disposed adjacent said pole opposite said frame means, a piston slidable in said brake tube, and, a piston rod extending between and secured to said piston and said frame top member, respectively.

2. The exerciser according to claim 1 in which said pole is tubular and further including:

an upright rod telescopically received by the upper end portion of said pole; and, said handle bars being secured to the upper end of said rod.

* * * * *